US005409420A

United States Patent [19]

Setteducati

[11] Patent Number: 5,409,420

[45] Date of Patent: Apr. 25, 1995

[54] SPECTATOR FAILURE TRICK INVOLVING SUSPENSION ILLUSION

[76] Inventor: Mark Setteducati, 218 E. 17 St., New York, N.Y. 10003

[21] Appl. No.: 85,284

[22] Filed: Jun. 30, 1993

[51] Int. Cl.[6] ..... A63H 33/26

[52] U.S. Cl. ..... 472/68; 472/54; 472/57; 446/129

[58] Field of Search ..... 446/129, 137, 396; 472/51, 54, 57, 68

[56] References Cited

U.S. PATENT DOCUMENTS

| | | | |
|---|---|---|---|
| D. 157,535 | 2/1950 | Quick | 446/396 X |
| 2,724,210 | 11/1955 | Gutierrez | 446/396 X |
| 3,818,630 | 6/1974 | May | 446/396 |
| 4,543,067 | 9/1985 | Wallen | 446/396 X |
| 5,163,647 | 11/1992 | Fader et al. | 446/396 X |

OTHER PUBLICATIONS

"Balancing Herkimer", *Popular Mechanics*, vol. 114, No. 6, Dec. 1960, p. 175.

Hoffman, Modern Magic, (George Routledge & Son) pp. 495–501.

John Javna, Cool Tricks, 1989 (Contemporary Books) p. 35.

T. A. Waters, The Encyclopedia of Magic and Magicians, 1989, p. 323.

Owen Magic Supreme, The Finest in Magic, Apr. 1984, p. 130.

Arthur Good, 100 Amazing Tricks, Corwen Books, N.Y. 1977 p. 11.

"The Imp Bottle".

"Cianti Bottle".

*Primary Examiner*—Carl D. Friedman
*Assistant Examiner*—Kevin D. Wilkens
*Attorney, Agent, or Firm*—Robert W. J. Usher

[57] ABSTRACT

A magician's prop comprise a flat body having an elongate body portion extending along a central axis rearward from a head and elongate lateral portions extending laterally and forward from locations on respective opposite sides of the body portion behind the head to free end portions protruding a small distance in front of the head. A ballast weight and a magnetic element of less weight are concealed in respective free end portions, with respective centers of gravity thereof spaced in front of the head. The resultant weight distribution of the body is such that, when extending horizontally, the surreptitious addition and removal of a hidden magnetic balance weight to the magnetic element by a magician's sleight of hand sets the object into and out of balance extending horizontally from a single pylon positioned under the head, the improbable horizontal balance providing an illusion that a portion of the body remote from the head is suspended. A second magnetic element can be provided to obtain an alternative point of adherence for the balance weight and a point of balance alternative to the head. The ballast weight can be omitted and a third magnetic element and a second balance weight.

16 Claims, 2 Drawing Sheets

SPECTATOR FAILURE TRICK INVOLVING SUSPENSION ILLUSION

FIELD OF THE INVENTION

The invention relates to a conjurer's or magician's trick of the spectator failure type involving a suspension illusion and to a conjurer's or magician's prop for effecting the trick.

BACKGROUND OF THE INVENTION

In a classical type of theatrical suspension illusion invented in the last century, the audience initially sees a person extending horizontally above the stage supported by front and rear pylons positioned under neck and ankle, respectively. The rear pylon is then removed, but the person remains in the same position extending from only the front pylon, with the rear part of the body apparently in a suspended state, to the amazement and delight of the audience.

This feat has been well known for more than a century and has taken many forms, the pylons being constituted by broomsticks, swords or even water fountains with glass or plastic pillars concealed therein.

A trick of the spectator failure type involving balance is also known and utilizes an "imp bottle" which the magician demonstrates as resting on its side and from which a rod-form weight is surreptitiously removed by the magician when handing the bottle to a spectator who cannot then make the bottle rest on its side.

Many scientific demonstrations involving improbable balance are known. One, for example, utilizes a flat, butterfly-shape blank of single thickness cut from a sheet of paper and having a central, longitudinal axis of symmetry, an elongate body portion extending axially rearward from a head and wing portions extending laterally and forward from opposite sides of the body portion with free end portions of the wings extending only a small distance in front of the head. The butterfly is made to balance in a horizontal plane with the head on a corner edge of a table or similar support, by adhering, with glue, sufficient balance weights to undersides of the free end portions of the wings to counterbalance the rearward extending body and thereby provide a center of gravity, balancing point or fulcrum coincident with the head. As substantially all the body mass still appears to extend rearward of the balancing point, the balance seems so improbable as to provide the illusion that the rearward extending portion of the body is suspended.

However, although the first-described type of classical suspension illusion is effective in the grand scale of a theater stage, as the person is required to wear a rigid, body supporting corset hidden under his clothing with a concealed rigid fastener 20 attached to the pylon which is itself attached by a concealed fitting to the stage, neither the person nor the front pylon will stand close inspection or handling by a spectator which would expose the corset or fastener, destroying the illusion. Thus, the classical form of the suspension illusion is not suitable for use on a magician's table stage close to an audience, nor for spectator participation, as would be required in a trick of the spectator failure type.

SUMMARY OF THE INVENTION

It is an object of the invention to provide a suspension illusion having props which will stand close inspection and handling both immediately before and after performance and is therefore suitable for incorporation in a trick of the spectator failure type.

Another object of the invention is to provide a trick of the spectator failure type which incorporates a suspension illusion.

It is also an object of the invention to provide a conjurer's or magician's trick of the spectator failure type in which the object appears to be suspended solely as a result of the influence of the magician.

This is achieved by the surreptitious addition and removal of a hidden balance weight to the object by a magician's sleight of hand to set the body into and out of balance.

According to one aspect, the invention comprises a magician's prop for a trick of a spectator failure type involving a suspension illusion, comprising a body of having an upper viewing face and a 20 lower concealed face and a central longitudinal axis of symmetry, an elongate body portion extending along the axis rearward from a head and elongate lateral portions extending laterally and forward from locations on respective opposite sides of the body portion behind the head to free end portions protruding a small distance in front of the head; a ballast weight and a magnetic element concealed in respective free end portions within a thickness of the body between the faces; and, a small magnetic balance weight which can adhere magnetically to the magnetic element, concealed from a spectator's view under the free end portion, so that the surreptitious addition and removal of the hidden balance weight to the body by a magician's sleight of hand sets the body into and out of horizontal balance on only the head, the horizontal balance providing an illusion that a portion of the body remote from the head is suspended.

The magnetic balance weight counterbalances the moments of the ballast weight and the rearward extending body portion so that the center of gravity or balancing point of the body is located at the head enabling the body to balance in a horizontally extending position on the tip of a pylon located only under the head. The magician surreptitiously removes the magnetic balance weight when handing the body to a spectator for close inspection, shifting the center of gravity of the body outside the body perimeter so that the spectator cannot, much to his amazement and confusion, then find the same or, indeed, any balancing point on the pylon.

The ballast weight and magnetic element are concealed within the thickness of the body, preferably in cavities formed in the free end portions.

The body may be formed, inexpensively, from cardboard, plastic or similar material having a masking sheet over upper and undersurfaces forming smooth, unbroken and flat surfaces with the upper sheet carrying an illustration of a man or bird-like character in which the laterally and forwardly extending portions form arms or wings and the head constitutes a nose or beak. The body may also be molded in relief instead of completely flat.

Preferably, first and second pillar-form pylons are provided for supporting the body.

According to another aspect of the invention, a magician's trick of the spectator failure type incorporating a suspension illusion comprises the steps of providing a body having an upper, viewing face and a lower, concealed face and a central longitudinal axis of symmetry, an elongate body portion extending rearward from a head along the axis of symmetry and elongate lateral portions extending laterally and forward from locations on respective opposite sides of the body portion behind the head to free end portions in front of the head; a ballast weight and a magnetic element concealed in respective free end portions within the thickness of the body between the faces; providing first and second pylons on a flat surface spaced apart from each other by a distance corresponding to the length of the body; surreptitiously, attaching a magnetic balance weight to the body, hidden under the concealed face, by magnetic adherence to the magnetic element so as to locate the center of gravity at the head; balancing the body extending horizontally on the pylons under head and rear ends thereof thereby providing an illusion that a portion of the body remote from the head is suspended; removing the rear pylon so that, to the surprise and delight of the spectator, the body remains extending horizontally from only the front pylon; removing the body from the front pylon and surreptitiously removing the balance weight and passing the body to a spectator for attempting to balance the body on the front pylon, without success.

The fact that the body remains improbably or impossibly balanced, apparently "suspended," after the removal of the rear pylon misdirects the spectator to suspect the secret to be in the pylon or in the nose of the body itself. This misdirection constitutes a very effective red-herring which increases the difficulty of finding the real secret. Finding none, increases the spectator's confusion and assists in establishing the illusory power of the magician whose credibility is reinforced by surreptitiously adding the magnet and repeating the same improbable balance that he has just witnessed.

In an alternative form, the invention provides a magician's prop for a trick of a spectator failure type involving a suspension illusion comprising a body and at least one concealed balance weight adherable to the body in at least one concealed position by magnetic attraction to bring the body into balance in a horizontal plane at an improbable, fulcrum eccentrically located within the body perimeter, thereby to provide an illusion that a portion of the body remote from the fulcrum is suspended. Suitably, the body is star-shaped and has upper and lower faces and radially extending arms and magnetic elements are concealed at respective apices of respective arms, fulcra being provided at respective junctions of respective adjacent arms and two of the balance weights are provided which can adhere magnetically to respective, individual magnetic elements of selected, pairs of magnetic elements, hidden from a spectator's view under the respective apices, so that surreptitious addition to and removal of the balance weights from adherence to the body by a magician's sleight of hand can set the body into and out of horizontal balance on alternative selected potential fulcra, the horizontal balance providing an illusion that a portion of the body remote from selected fulcra is suspended.

Desirably, the potential fulcrum are formed by body portions projecting radially outwardly for a small distance at a location between each arm.

BRIEF DESCRIPTION OF THE DRAWINGS

An embodiment of the invention will now be described by way of example only and with reference to the accompanying drawings in which.

DESCRIPTION OF PARTICULAR EMBODIMENT

Figure 1:
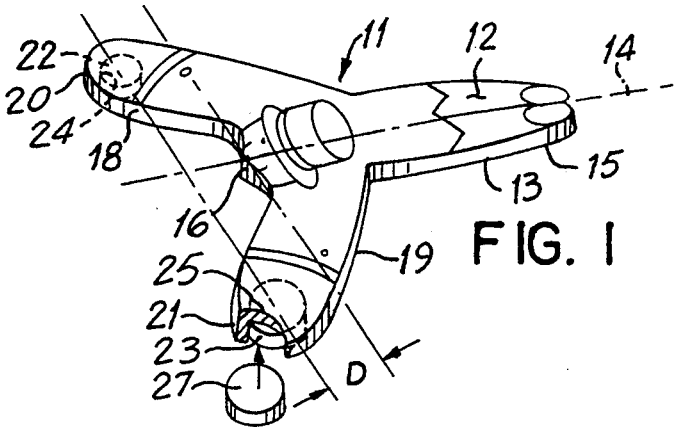
FIG. 1 is a perspective view, partly broken away, of a magician's prop with a magnetic balance weight aligned for adherence thereto.

As seen most particularly in FIG. 1, a magician's prop comprise a substantially flat body 11 of small thickness having an upper, viewing face 12 and a lower, concealed face 13 and a central longitudinal axis of symmetry 14, indicated by the broken lines. An elongate body portion 15 extends along the axis rearward from a head 16 and elongate lateral portions 18 and 19, respectively, extend laterally and forward from locations on respective opposite sides of the body portion 15 behind the head 16 to free end portions 20 and 21, respectively, in front of the head. A disk-form ballast weight 22 and a disk-form magnetic element 23 of half the weight thereof are concealed within the thickness of the body by receipt in respective cavities 24 and 25, formed in respective free end portions, with respective centers of gravity thereof located on an axis spaced by a distance D in front of the head. The weight distribution of the body is such that, when extending horizontally, the center of gravity lies outside the perimeter so that a single balancing point or fulcrum cannot be found.

A small, disk-form magnetic balance weight 27 is one half the weight of the ballast weight and can adhere magnetically to the magnetic element to counterbalance the moments of the rearward extending body and ballast weight to shift the center of gravity, balancing point or fulcrum to the head.

The body is cut from a sheet of thick cardboard but, alternatively, may be of wood or plastic, and masking sheets 31 and 32, respectively, are adhered over upper and undersurfaces, respectively, masking the cavities and forming smooth, unbroken and flat surfaces. The upper sheet 31 carries an illustration of a man character in which the laterally and forwardly extending portions form arms and the head constitutes a nose. First and second pillar-form pylons 33 and 34, respectively, are provided for supporting the body.

Figure 2:
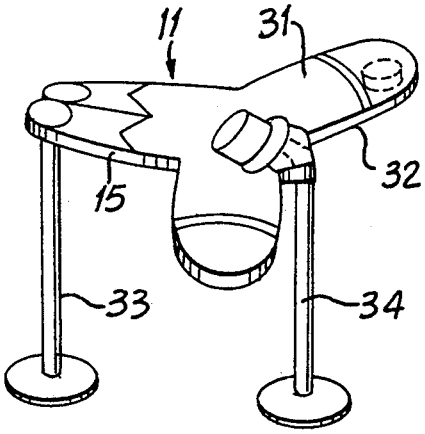
FIG. 2 is a perspective view of the magician's prop viewed from above and one side showing the body balancing horizontally apparently supported by front and rear pillars.
Figure 3:
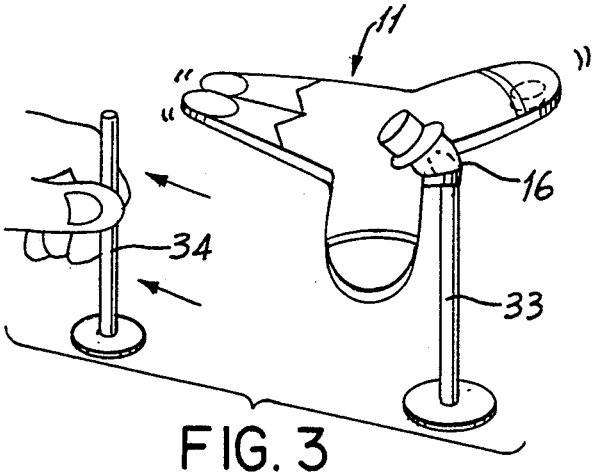
FIG. 3 is a perspective view similar to FIG. 2 but after removal of the rear pillar, showing the body balancing horizontally on only the front pillar.

The trick is performed by first placing the first and second pylons on a flat surface spaced apart from each other by a distance corresponding to the length of the body, surreptitiously, attaching the magnetic balance weight to the body, hidden under the concealed face, by magnetic adherence to the magnetic element so as to locate the center of gravity at the nose and balancing the body extending horizontally on the pylons under nose and rear ends thereof, as shown in FIG. 2. The magician then removes the rear pylon so that the body remains extending horizontally from only the front pylon with the rear portion of the body apparently "suspended", as shown in FIG. 3. The magician may then pass a hoop over the rear portion of the body to prove that there is only the front support.

Figure 4:
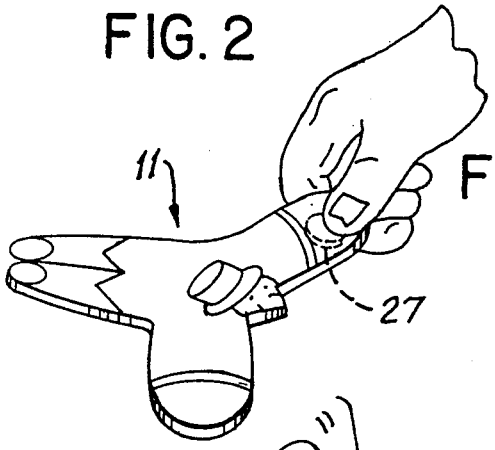
FIG. 4 is a perspective view of the magician's prop showing the magician's hand positioned for surreptitious removal of the magnetic balance weight.
Figure 5:
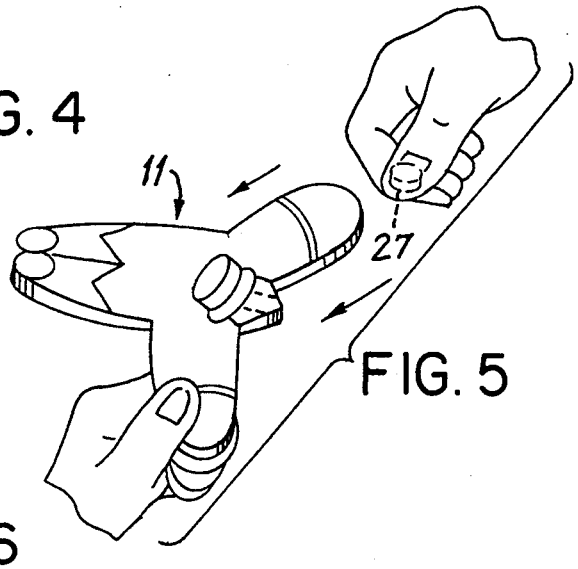
FIG. 5 is a perspective view showing the magician surreptitiously removing the magnetic balance weight while handing the prop to a spectator.
Figure 6:
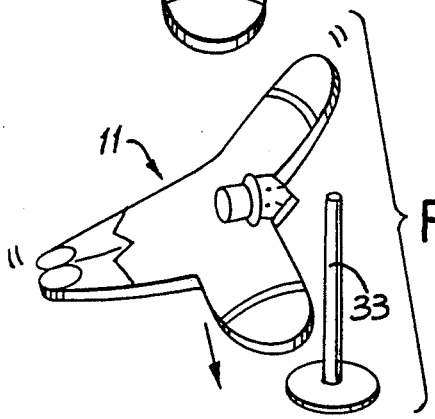
FIG. 6 is a perspective view showing the body toppling from the front pillar after an unsuccessful attempt by a spectator to balance the body thereon.

The magician then removes the body from the front pylon while concealing the balance weight with his hand, as shown in FIG. 4, and hands the body to a spectator to attempt the balance, while surreptitiously removing (palming) the balance weight, as shown in FIG. 5. As the removal of the balance weight places the center of gravity outside the perimeter of the body, the spectator fails to find any single point of balance on the pylon and both topple with the attempt, as shown in FIG. 6.

This provides the impression that the object was suspended or balanced solely as a result of the magicians supernatural powers, such impression being reinforced by the magician subsequently picking up the object while surreptitiously adding the counterweight thereto and again placing the object into horizontal balance on the single pylon.

Figure 7A:
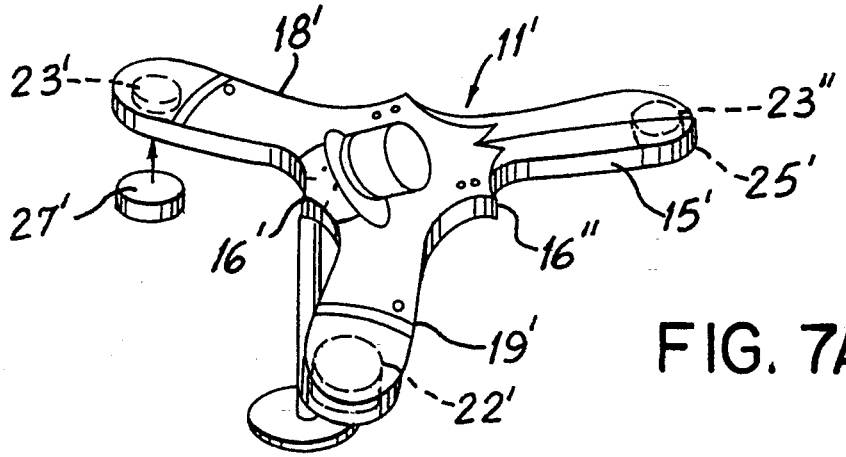
FIGS. 7A and 7B are perspective views of a second embodiment in alternative positions of balance.
Figure 7B:
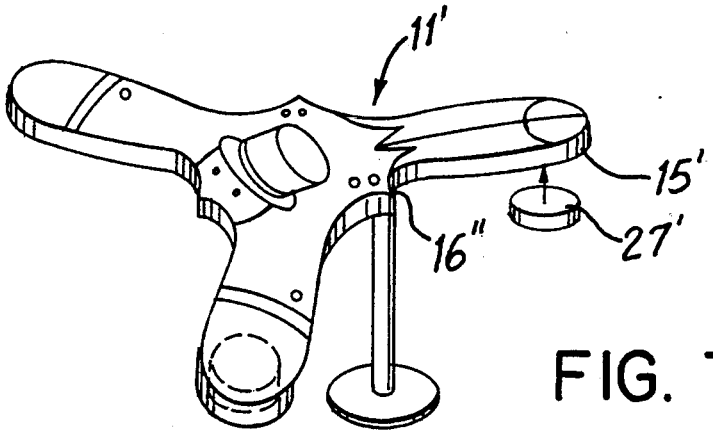

The second embodiment, shown in FIGS. 7A and 7B, is generally similar to the first except that the positions of the ballast weight 22' and magnetic element 23' are switched from those of the first embodiment, and a second, disk-form magnetic element 23'', identical to the first, is mounted concealed within the thickness of the body 11' by receipt in a cavity formed in a free end of the body portion 15' enabling an alternative balancing point 16' to be found by magnetic adhesion of the counterweight 27' thereto. The body 11' is essentially symmetrical and the second balancing point is provided by a projection 16'' of similar shape to the nose 16' extending radially outwardly from the body portion at the junction of the lateral portion 19' and the body portion 15' and forming the corner of a tail coat illustrated on the upper face. A second axis of symmetry passes through the projection 16'' and bisects the laterally extending portion 18'.

In this embodiment, following a procedure similar to that previously described, the magician also has the option of bringing the body into balance with either the nose 16' or the coat corner 16'' resting on the pylon, as shown in FIGS. 7A and 7B, respectively, by switching positions of the magnetic balance weight 27' between arms 18' and the free end or foot of body portion 15'.

Figure 8:
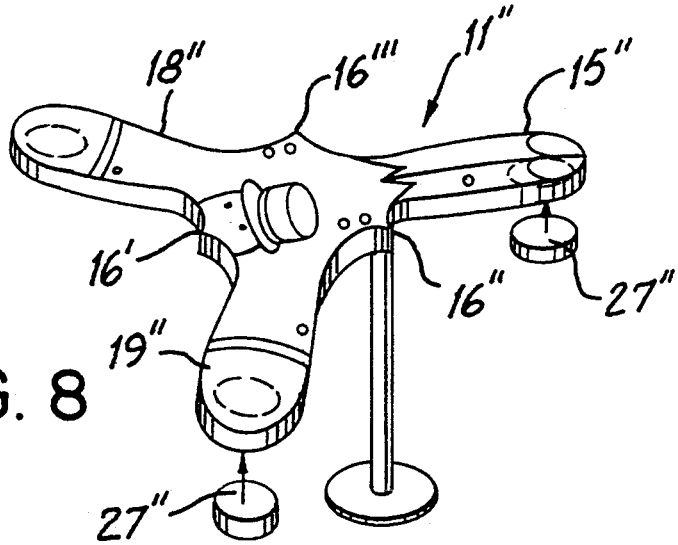
FIG. 8 is a perspective view of a third embodiment of the invention.

In a third embodiment, shown in FIG. 8, the body 11'' is completely symmetrical with disc-form magnetic elements or shims in cavities in respective free ends or apices of radially extending arms or points 15'', 18'' and 19'', which correspond to the body and lateral portions of the earlier described embodiments, and which are equal in size, shape and mass and subtend equal angles. Three axis of symmetry pass, respectively, through the nose 16', projections 16'' and 16''', and bisect the body portion 15'' and radially extending arms 18'' and 18''', respectively.

An additional magnetic balance weight replaces the ballast weight of the earlier embodiments enabling the magician to bring the body into balance on any of three balancing points or fulcra provided by the nose 16', or either coat corner 16'' or 16''', palming both counterweights when passing the body to the spectator and altering the chosen balance point, further increasing the confusion of spectators.

This embodiment provides the advantage that, as the ballast weights of the earlier embodiments are omitted, the body weight seems to the spectator to be evenly distributed throughout the body, making it more difficult for the spectator to suspect the solution to be weight compensation. However, a balance point may be found within the perimeter of the body in the absence of the counterweights.

Instead of using discrete magnetic elements or surfaces, the entire body may be of magnetic material, for example, stamped from sheet metal.

I claim:

1. A magician's prop for a trick of a spectator failure type involving a suspension illusion comprising a body having an upper viewing face and a lower concealed face and a central longitudinal axis of symmetry, an elongate body portion extending along the axis rearward from a head, and elongate lateral portions extending laterally and forward from locations on respective opposite sides of the body portion behind the head to free end portions protruding in front of the head by a distance which is small relative to a length of the body portion; a ballast weight and a magnetic element concealed in respective free end portions within a thickness of the body between the faces; and, a small magnetic balance weight adhereable magnetically to the magnetic element, concealed from a spectator's view under the free end portion, so that the surreptitious addition and removal of the hidden balance weight to the body by a magician's sleight of hand sets the body into and out of horizontal balance on the head, the horizontal balance providing an illusion that a portion of the body remote from the head is suspended.

2. A magician's prop according to claim 1 in which the ballast weight and magnetic element are concealed within the thickness of the body in cavities formed in the free end portions.

3. A magician's prop according to claim 2 in which the body has sheets covering the cavities so as to form smooth, unbroken and flat surfaces over the entire upper and undersurfaces thereof, the upper sheet carrying an illustration of a human character of which the laterally and forwardly extending portions form arms and the head forms a nose.

4. A magician's prop according to claim 1 in which the body carries an illustration of a human character on the upper face thereof of which the laterally and forwardly extending portions form arms and the head forms a nose.

5. A magician's prop according to claim 1 including first and second pylons for supporting the head and a rear end of the body portion, respectively.

6. A magician's prop according to claim 5 in which the first and second pylons are formed by pillars.

7. A magician's prop according to claim 1 in which the body portion is substantially flat.

8. A magician's prop according to claim 1 in which a cavity is formed in the rear end of the body portion and a second, magnetic element, similar to the first, is mounted therein, concealed within the thickness of the body portion, enabling an alternative balancing point to be found by magnetic adhesion of the balance weight thereto.

9. A magician's prop according to claim 8 in which the body portion is essentially symmetrical and the alternative balancing point is provided by a projection of similar shape to a nose and extending outwardly from the body portion at a junction of a lateral portion and the body portion and forming the corner of a tail coat illustrated on the upper face, a second axis of symmetry passing through the projection and bisecting a remote lateral portion.

10. A magician's trick of the spectator failure type incorporating a suspension illusion comprising the steps of:

providing a Body having an upper, viewing face and a lower, concealed face and a central longitudinal axis of symmetry, an elongate body portion extending rearward from a head along the axis of symmetry and elongate lateral portions extending laterally and forward from locations on respective opposite sides of the body portion behind the head to free end portions protruding in front of the head by a distance which is small relative to a length of the body portion; a ballast weight and a magnetic element concealed in respective free end portions within a thickness of the body between the faces;

providing first and second pylons on a flat surface spaced apart from each other by a distance corresponding to the length of the body;

surreptitiously, attaching a magnetic balance weight to the body, hidden under the concealed face, by magnetic adherence to the magnetic element so as to locate the center of gravity at the head;

balancing the body extending horizontally on the pylons under head and rear ends thereof thereby providing an illusion that a portion of the body remote from the head is suspended;

removing the rear pylon so that the body remains extending horizontally from only the front pylon;

removing the body from the front pylon and surreptitiously removing the balance weight and passing the body to a spectator for attempting to balance the body on the front pylon, without success.

11. A magician's prop for a trick of a spectator failure type involving a suspension illusion comprising a body having a center of gravity outside a horizontal perimeter thereof in plan view and at least one concealed balance weight adhereable to the body in at least one concealed position by magnetic attraction to bring the body into balance in a horizontal plane at an improbable, eccentric fulcrum within the body perimeter, thereby to provide an illusion that a portion of the body remote from the fulcrum is suspended.

12. A magician's prop for a trick of a spectator failure type involving a suspension illusion comprising a body and at least one concealed balance weight adherable to the body in at least one concealed position by magnetic attraction to bring the body into balance in a horizontal plane at an improbable, fulcrum eccentrically located within the body perimeter, thereby to provide an illusion that a portion of the body remote from the fulcrum is suspended.

13. A magician's prop for a trick of a spectator failure type according to claim 12 in which the body is star-shaped and has upper and lower faces and radially extending arms and magnetic elements are concealed at respective apices of respective arms, fulcra being provided at respective junctions of respective adjacent arms and two of the balance weights are provided adhereable magnetically to respective, individual magnetic elements of selected, pairs of magnetic elements, hidden from a spectator's view under the respective apices, so that surreptitious addition to and removal of the balance weights from adherence to the body by a magician's sleight of hand sets the body into and out of horizontal balance on alternative selected fulcra, the horizontal balance providing an illusion that a portion of the body remote from selected fulcra is suspended.

14. A magician's prop for a trick of a spectator failure type according to claim 12 in which the fulcra are formed by body portions projecting radially outwardly for a distance at a location between each arm which distance small compared with a length of an arm.

15. A magician's trick of the spectator failure type incorporating a suspension illusion comprising the steps of:

providing a body having an upper, viewing face and a lower concealed face, a plurality of magnetic elements concealed in the body and two concealed balance weights adhereable to the body in at least one concealed position by magnetic attraction;

surreptitiously, attaching the balance weights to the body, hidden under the concealed face, by magnetic adherence to the magnetic elements so as to locate the center of gravity of the body at a balancing point located eccentrically on the body;

initially balancing the body in a horizontal plane at the balancing point on an upstanding support, thereby to provide an illusion that a portion of the body remote from the balancing point s suspended;

removing the body from the Support and surreptitiously removing the balance weights and passing the body to a spectator for attempting to balance the body at the said balancing point on an upstanding support, without success.

16. A magician's trick according to claim 15 including the steps of providing, in spaced apart relation, first and second pylons for constituting the upstanding support and a dummy support, respectively, and initially balancing the body extending horizontally on both pylons, located under the balancing point and under the portion of the body remote from the balancing point, respectively, and removing only the second pylon so that the body remains extending horizontally from only the front pylon thereby enhancing the suspension illusion of the initial balance.

* * * * *